US008875317B2

(12) United States Patent
Jacobs

(10) Patent No.: US 8,875,317 B2
(45) Date of Patent: Nov. 4, 2014

(54) SPEAKER HAT

(71) Applicant: Eugene Jacobs, Columbia, SC (US)

(72) Inventor: Eugene Jacobs, Columbia, SC (US)

( * ) Notice: Subject to any disclaimer, the term of this patent is extended or adjusted under 35 U.S.C. 154(b) by 0 days.

(21) Appl. No.: 13/918,211

(22) Filed: Jun. 14, 2013

(65) Prior Publication Data

US 2014/0109294 A1 Apr. 24, 2014

Related U.S. Application Data

(60) Provisional application No. 61/795,469, filed on Oct. 18, 2012, provisional application No. 61/689,901, filed on Jun. 15, 2012.

(51) Int. Cl.
*A42B 1/24* (2006.01)

(52) U.S. Cl.
CPC ..... *A42B 1/245* (2013.01)
USPC ..... 2/209.13

(58) Field of Classification Search
USPC ..... 2/208.13, 171, 209.12, 209.3, 175.1, 2/175.5, 195.1, 906; 362/105, 106, 253
See application file for complete search history.

(56) References Cited

U.S. PATENT DOCUMENTS

| | | | | |
|---|---|---|---|---|
| 321,581 | A | 7/1885 | Carricaburu | |
| 2,754,497 | A * | 7/1956 | Wolpert | 340/575 |
| 4,130,803 | A | 12/1978 | Thompson | |
| 4,525,878 | A | 7/1985 | Lowe, Jr. | |
| 4,776,044 | A | 10/1988 | Makins | |
| 5,410,746 | A | 4/1995 | Gelber | |
| 5,510,961 | A | 4/1996 | Peng | |
| 5,522,092 | A | 6/1996 | Streb et al. | |
| 5,724,678 | A | 3/1998 | McCallum et al. | |
| 5,845,987 | A | 12/1998 | Painter | |
| 5,881,390 | A * | 3/1999 | Young | 2/209.13 |
| 6,732,381 | B1 * | 5/2004 | Lal | 2/425 |
| 7,031,068 | B2 | 4/2006 | Himmele | |
| 7,044,615 | B2 | 5/2006 | Gesten | |
| 7,052,154 | B2 | 5/2006 | Vanderschuit | |
| 7,862,194 | B2 | 1/2011 | Seade | |
| 8,503,711 | B2 * | 8/2013 | Flynn | 381/375 |
| 8,670,587 | B2 * | 3/2014 | Townsend | 381/388 |

* cited by examiner

*Primary Examiner* — Tejash Patel
(74) *Attorney, Agent, or Firm* — Dority & Manning, PA

(57) ABSTRACT

The present disclosure provides a hat structure comprising a crown and various electronics. The electronics include a speaker located on the crown and defining a direction of sound propagation outwardly from a rear side of the crown. The speaker is configured to play a sound in the direction of sound propagation in response to a user input to a control switch. A hat structure of such a configuration may provide sound more clearly to the environment surrounding a user or wearer of the hat structure.

19 Claims, 7 Drawing Sheets

SPEAKER HAT

CROSS-REFERENCE TO RELATED APPLICATION

The present application claims the benefit of U.S. Provisional Application Ser. No. 60/689,901 filed Jun. 15, 2012 and U.S. Provisional Application Ser. No. 61/795,469 filed Oct. 18, 2012. Each of these Applications is hereby incorporated by reference.

FIELD

The present disclosure is directed to a hat having a speaker, or more particularly to a hat having a speaker configured to propagate sound outwardly from the rear of the hat.

BACKGROUND

Patrons of sports teams often wear baseball-style hats and other memorabilia in support of their favored sports team. Commonly, such patrons listen to the announcers announcing the game over the radio on handheld radio devices and headphones. In order to make this experience easier, some hats in the art include speakers in, for example, the bill of the hat connected to a radio transmitter to allow the user to listen to the announcers over the radio. These speakers are configured to propagate sound downward towards the user in order to maximize the amount of sound the user can hear from the speakers. Other hats in the art are similarly designed outside of the sports context to allow the wearer of the hat to listen to music from the radio or music from an external sound source, such as a compact disc player or MP3 player.

Certain problems exist with the above configurations, however. For example, the referenced hats are designed such that the speakers direct the sound from, for example, the bill of the hat downward and/or inward towards the user to enhance the listening quality for the user. Accordingly, the above hats are not well suited for playing a sound to be heard by persons, or the environment generally, around the wearer—a hat so configured would be particularly useful in the art.

SUMMARY

Aspects and advantages of the present disclosure will be set forth in part in the following description, or may be apparent from the description, or may be learned through practice of the disclosure.

In one exemplary embodiment of the present disclosure, a hat structure is provided including a crown defining a front side and a rear side, the crown configured for receipt of a head of a user, and a control board located within the crown and having a sound source associated therewith. The hat structure also includes a power source, the power source being in communication with the control board and a speaker located on the crown and defining a direction of sound propagation outwardly from the rear side of the crown, the speaker being in communication with the control board. Additionally, the hat structure includes a control switch associated with the control board, the control switch configured to receive a user input and communicate the user input to the control board, wherein in response to the user input, the control board communicates a signal from the sound source to the speaker and the speaker plays a sound in the direction of sound propagation.

In another exemplary embodiment of the present disclosure, a baseball-style hat having a speaker is provided, including a semi-spherical crown defining a front side, a back side, and an inside area, the inside area configured to receive a head of a user. The baseball-style hat also includes a bill extending from and attached to the front side of the crown and a control switch positioned on the bill and configured to receive a user input. Additionally, the baseball-style hat includes a speaker in communication with the control switch and located on the back side of the crown, the speaker defining a direction of sound propagation pointed away from the inside area of the crown and configured to play a sound in response to the user input received by the control switch.

These and other features, aspects and advantages of the present disclosure will become better understood with reference to the following description and appended claims. The accompanying drawings, which are incorporated in and constitute a part of this specification, illustrate embodiments of the disclosure and, together with the description, serve to explain the principles of the disclosure.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION

Figure 1:
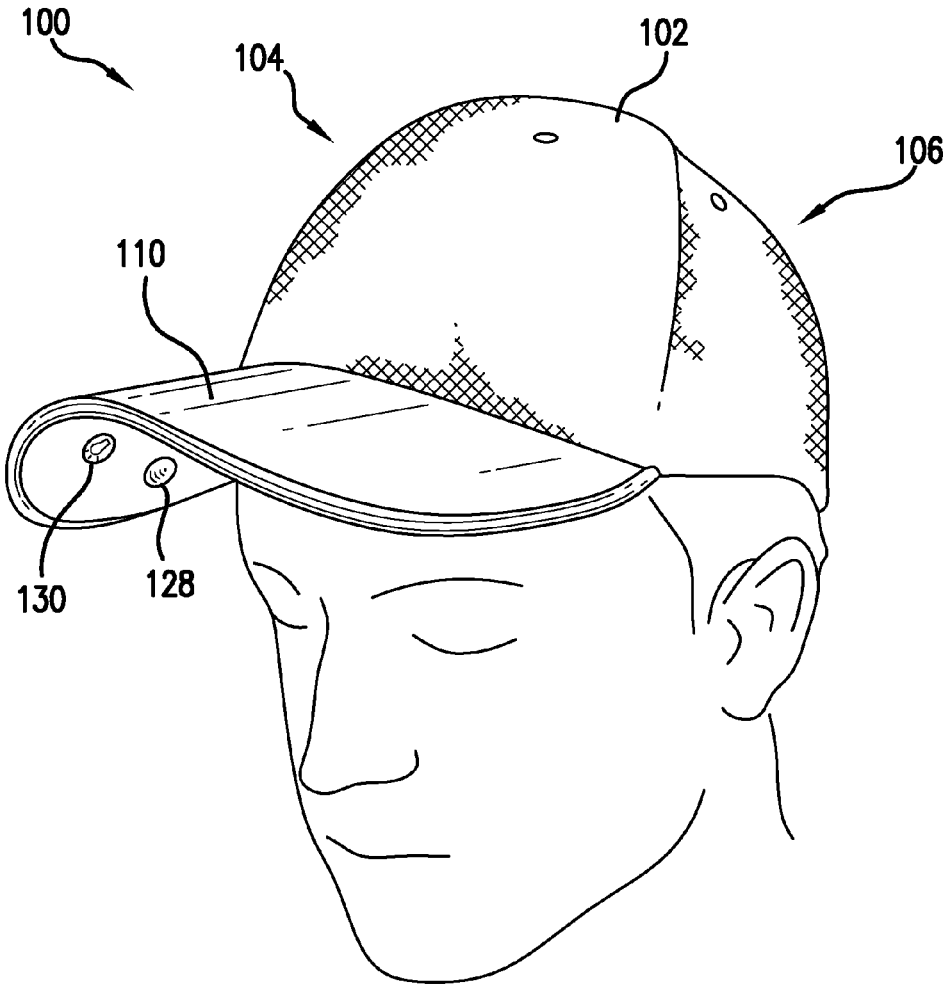
FIG. 1 provides a perspective view of an exemplary embodiment of a hat according to the present disclosure.

Reference now will be made in detail to embodiments of the disclosure, one or more examples of which are illustrated in the drawings. Each example is provided by way of explanation of the disclosure, not limitation of the disclosure. In fact, it will be apparent to those skilled in the art that various modifications and variations can be made in the present disclosure without departing from the scope or spirit of the disclosure. For instance, features illustrated or described as part of one embodiment can be used with another embodiment to yield a still further embodiment. Thus, it is intended that the present disclosure covers such modifications and variations as come within the scope of the appended claims and their equivalents.

Referring now to the drawings, FIG. 1 provides a perspective view of an exemplary embodiment of a hat structure 100 according to the present disclosure. The hat 100 includes generally a crown 102 defining a front side 104 and a rear side 106. For the exemplary embodiment of FIG. 1, the crown 102 generally has a semi-spherical shape and is configured for receipt of a head of a user.

The exemplary hat 100 of FIG. 1 is a baseball-style hat and further includes a bill 110 attached to and extending from the front side 104 of the crown 102. The bill 110 may, for instance, provide the user relief from overhead light, such as sunlight. It should be appreciated, however, that although the exemplary hat 100 of FIG. 1 is shown having the front side 104 and the bill 110 facing forward relative to the user, in other embodiments, the user may wear the hat 100 such that the rear side 106 of the crown 102 is facing forward relative to the user, or in any other suitable orientation.

It should also be appreciated, however, in other exemplary embodiments of the present disclosure, the hat structure 100 may have any other suitable configuration. For example, in other exemplary embodiments, the hat structure may not include a bill 110, and alternatively may include a brim extending around a perimeter of the crown 102. In still other exemplary embodiments, the hat structure 100 may be what is conventionally referred to as a "visor," wherein the top of the crown 102 in open.

Figure 2:
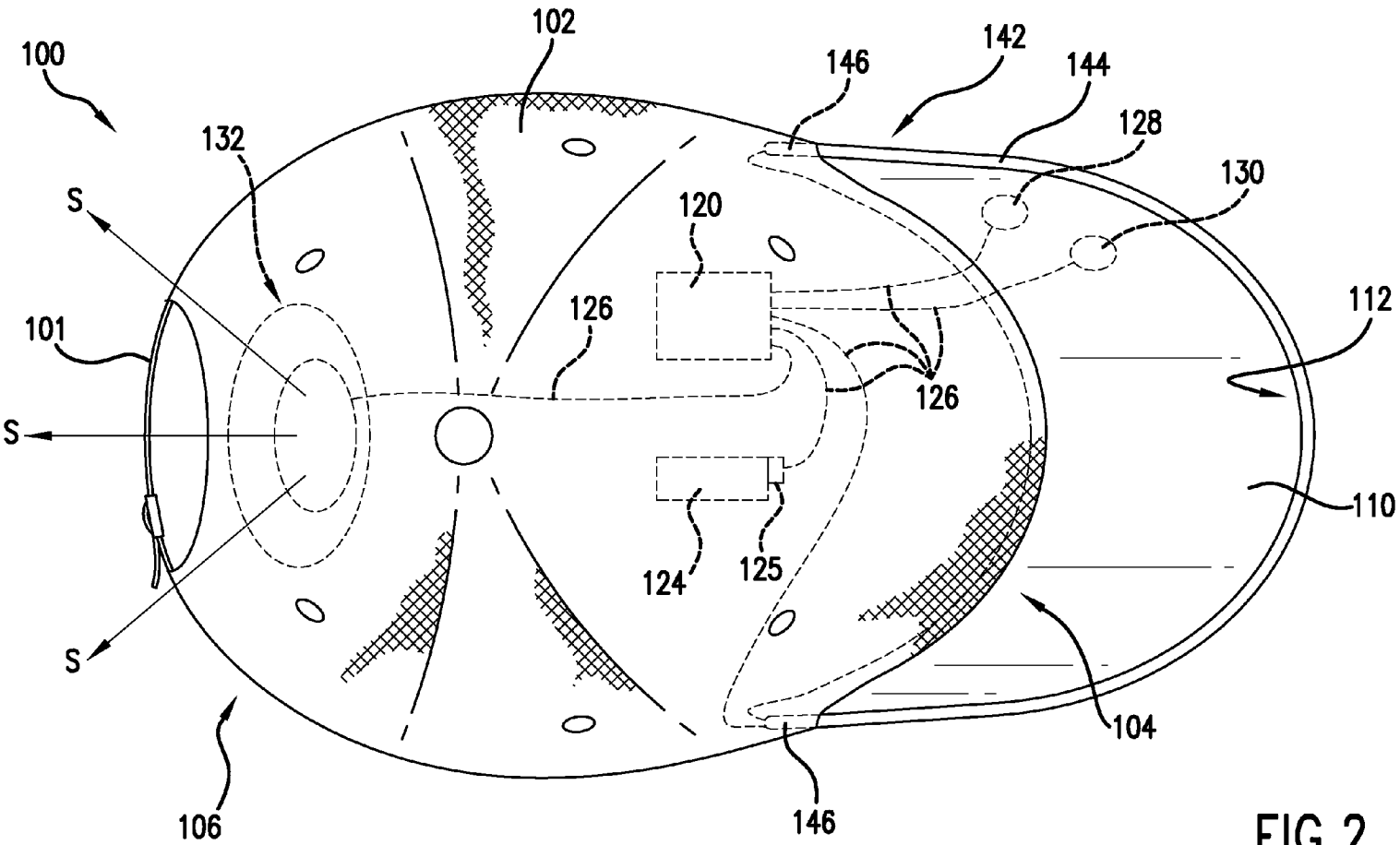
FIG. 2 provides a top view of an exemplary hat according to an exemplary embodiment of the present disclosure.
Figure 3:
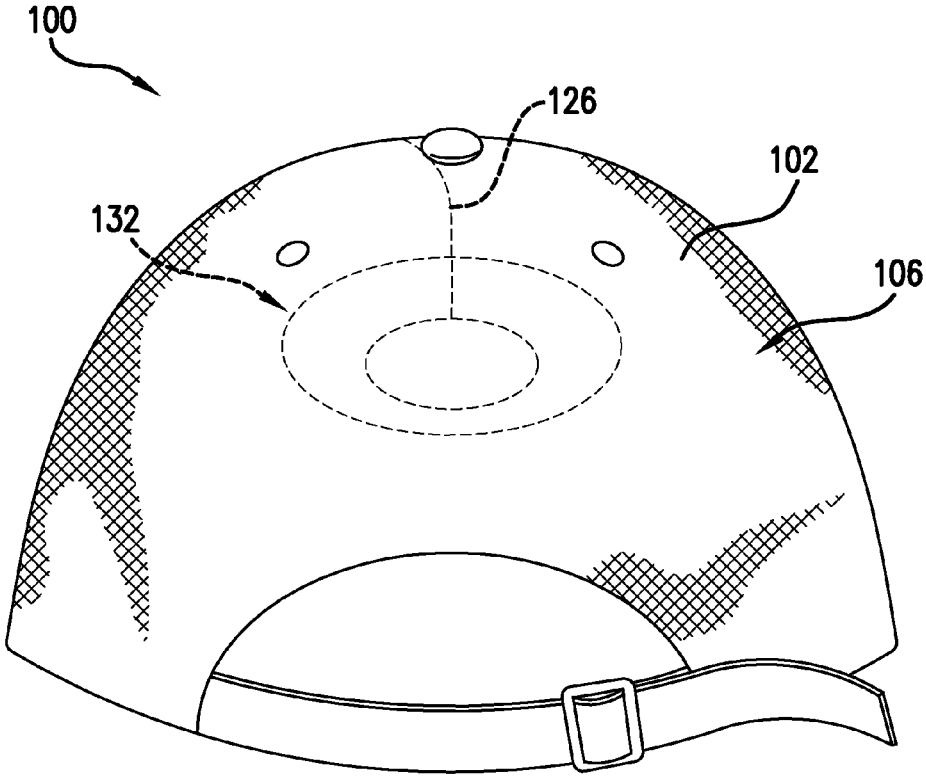
FIG. 3 provides a rear view of an exemplary hat according to an exemplary embodiment of the present disclosure.
Figure 4:
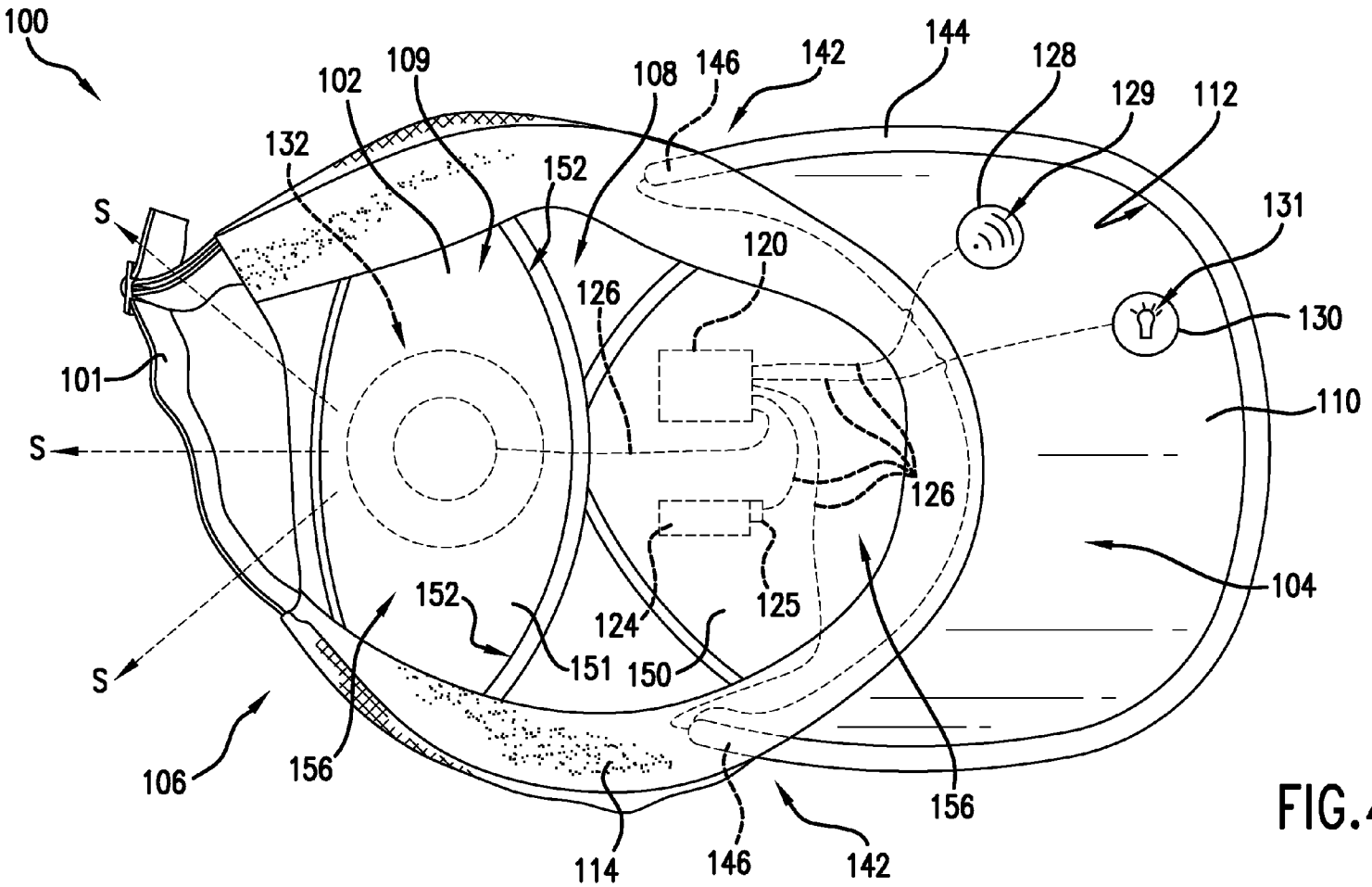
FIG. 4 provides a bottom view of an exemplary hat according an exemplary embodiment of to the present disclosure.

Referring now to FIGS. 2, 3, and 4, a top, a rear, and a bottom view of an exemplary embodiment of the hat 100 are provided having various electrical components shown in phantom. The various electrical components will be explained in more detail below, with reference to FIG. 5. Generally, however, the electronics associated with the exemplary hat structure 100 include a speaker 132, a control board 120, a power source 124, a control switch 128, and a light emitting device 142. The speaker 132 is located on the crown 102 and defines a direction of sound propagation S outwardly from, or relative to, the rear side 106 of the crown 102. The speaker 132 is configured to play a sound in response to a user input received by the control switch 128. A hat structure 100 of such a configuration can propagate sound to the environment of the user such that persons behind and/or around the user can more clearly hear the sound coming from the speaker 132.

Additionally, the exemplary light emitting device 142 is in communication with the control board 120 and the hat structure 100 further includes a second control switch 130. The second control switch 130 is also in communication with the control board 120 and is configured to receive a user input corresponding to a command to activate the light emitting device 142. The exemplary light emitting device 142 may provide increased safety for the user or wearer. For example, such a light emitting device 142 may provide increased awareness of the user's presence to the user's environment when the user is, e.g., attending or leaving an evening sporting event, riding a bicycle or jogging during early morning or evening hours, or even hunting.

With specific reference to the exemplary embodiment of FIG. 4, hat structure 100 additionally includes an adjustable strap 101 at the rear side 106 to allow the size of the crown to adjust to the size of the user's head. Further, within an inside area 109 of the crown 102, a sweatband 114 is also provided, attached to a lower portion of an inside surface 108 of the crown 102. The sweatband 114 may be attached to the crown 102 by sewing. Also within the inside area 109 of the crown 102 are a first pad 150 and a second pad 151, each defining an end 152 attached to an inside surface 108 of the crown 102. Specifically, the first pad 150 is attached at an end 152 to an edge of the inside surface 108 of the crown 102, beneath the sweatband 114. The second pad 151 is attached at opposing ends 152 to the inside surface 108 of the crown 102, forming an opening for the speaker 132. The pads 150, 151 may also be attached to the crown 102 by sewing.

For the exemplary embodiment of FIG. 4, the first and second pads 150, 151 each define a first side 154 (see FIG. 5) and an opposite second side 156. The first side 154 (see FIG. 5) is configured to face the inside surface 108 of the crown 102 and contact one or more of the power source 124, the control board 120, the speaker 132, and portions of the light emitting device 142. The second side 156 is configured to be positioned adjacent to the head of the user when the hat structure 100 is worn. In certain embodiments, the second side 156 may be configured to contact the head of the user when the hat structure is worn. Accordingly, the first and second pads 150, 151 can offer protection for the various electrical components in the hat 100, while also minimizing discomfort to the user when the hat 100 is worn.

It should be appreciated, however, that in other exemplary embodiments, the hat structure 100 may include any suitable number of pads in any suitable configuration. Alternatively, in other exemplary embodiments, the hat structure 100 may not include any pads.

Figure 5:
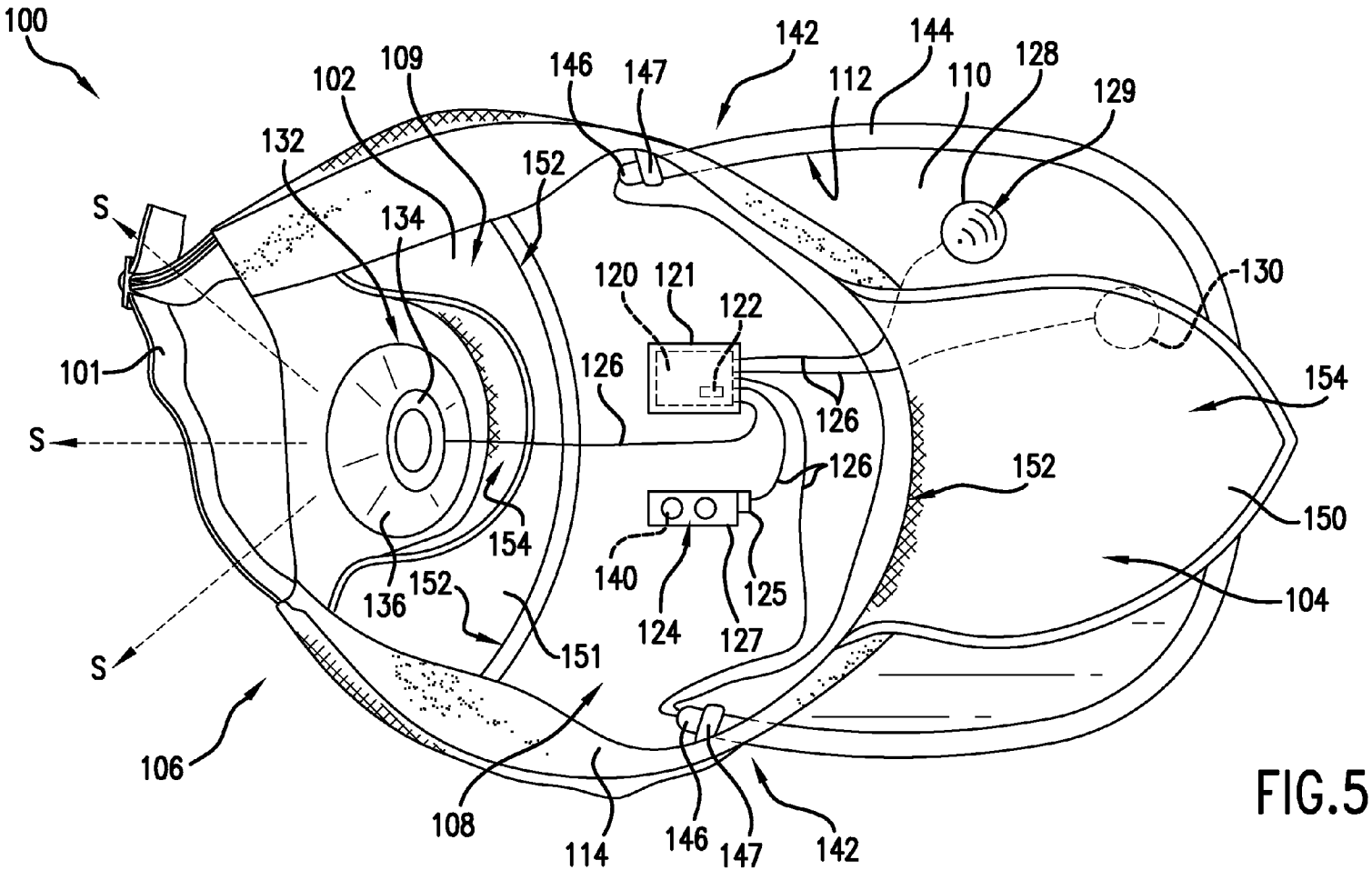
FIG. 5 provides a bottom view of an exemplary hat according to an exemplary embodiment of the present disclosure wherein the electrical components are exposed.

Referring now to the exemplary embodiment of FIG. 5, a bottom view of the hat structure 100 is provided, having the pads 150, 151 pulled back and the various electrical components exposed. As shown, for the exemplary embodiment of FIG. 5, the hat structure 100 includes a control board 120 located within the crown 102, which has a sound source associated therewith. Additionally, the power source 124 is located within the crown 102 and is in communication with the control board 120, the speaker 132 is located adjacent to the rear side 106 of the crown 102 and is also in communication with the control board 120, and the control switch 128 is positioned on the bill 110 and is also in communication with the control board 120. For the exemplary embodiment of FIG. 5, the power source 124, the speaker 132, and the control switch 128 are each in wired communication with the control board 120. It should be appreciated, however, that in other exemplary embodiments, the speaker 132, the control switch 128, or both can be in wireless communication with the control board. For example, the speaker 132, the control switch 128, or both may communicate with the control board 120 using Bluetooth or infrared technology.

With continued reference to FIG. 5, the control board 120 is shown in phantom positioned within a housing 121 and the sound source is a memory device 122 located on the control board 102. As shown, the housing 121 and control board 120 are located on the inside surface 108 of the crown 102. The housing 121 may provide additional protection for the control board 120 and may be attached to the inside surface 108 of the crown 102 in any suitable manner. For example, the housing 121 may be glued to the inside surface 108 using a hot melt adhesive, or alternatively one or more pieces of VELCRO may be used to attach the housing 121 to the inside surface 108 of the crown 102.

For the exemplary embodiment of FIG. 5, the housing 121 is a cloth pouch. However, it should be appreciated that in other exemplary embodiments, the housing 121 may be any suitable housing. For example, in other exemplary embodiments, housing 121 may be a hard case comprised of a suitable hard molded plastic material. Alternatively, in still other exemplary embodiments, the hat 100 may not include a housing 121 and/or the control board 120 may not be attached to the inside surface 108 of the crown 102.

As stated, for the exemplary embodiment of FIG. 5 the sound source is a memory device 122 located on the control board 120. The memory device 122 may store a signal to be communicated to the speaker 132 and may be integrally and/ or directly connected to the control board 120. The signal may be prerecorded, or may be recorded in response to a user input to control switch 128. Additionally, the memory device 122 may store a plurality of signals to be communicated to the speakers 132 in, for example, a sequential order or a random order.

It should be appreciated however, that in other exemplary embodiments, the sound source may be any sound source positioned on the control board 120 or in communication with the control board. For example, the sound source may be an AM/FM radio receiver positioned on the control board. Alternatively, the sound source may be an external sound source in communication with the control board 120 through, for example, a 3.5 mm audio jack or any suitable wireless technology. In such a configuration, the external sound source may be, for example, a compact disc player, an MP3 player, an AM/FM radio, or any other suitable external sound source.

With continued reference to the exemplary embodiment of FIG. 5, the power source 124 is in electrical communication with the control board 120 via wires 126 and is also located on the inside surface 108 of the crown 102. The power source 124 also includes a switch 125 configured to allow the power source 124 to provide the control board 120 with electrical power when in the "On" position, and configured to prevent the power source 124 from providing electrical power to the control board 120 when in the "Off" position. The switch 125 may be actuated between the On and Off positions by the user.

The exemplary power source 124 includes a housing 127 and two batteries 140. The housing 127 may be comprised of a hard molded plastic and may be attached to the inside surface 108 of the crown 102 by using a hot melt adhesive. In other exemplary embodiments, however, the housing 127 may not be attached to the crown 102, and may instead be held in place by, for example, the pad 150. For the exemplary embodiment of FIG. 5, the batteries 140 are two "button-type" batteries. Such a configuration can allow the power source 124 to have a relatively flat and lightweight configuration so as to minimize discomfort to the user. In other exemplary embodiments, however, the batteries 140 may be any suitable type and/or size. For example, in other exemplary embodiments the batteries 140 may be a size AAA, size AA, or 9 volt battery, which may allow power source 124 to provide sufficient power to control board 120 for prolonged activation of the speaker 132 and/or light emitting device 142.

The speaker 132 is also in wired communication with the control board 120 and includes a speaker core 134 positioned in a speaker housing (not shown) with a foam support structure 136 positioned therearound. The housing may be comprised of a hard plastic material and may hold the speaker in position by being attached to the inside surface 108 of the crown 102 using a hot melt adhesive. Alternatively, however, the speaker 132 may be held in position within the crown 102 by either attaching the foam support structure 136 to the inside surface 108 of the crown using, for example, a hot melt adhesive, or by attaching the second pad 151 to the crown 102 such that the second pad 151 supports the speaker 132. For the exemplary embodiment of FIG. 5, the speaker core 134 is circular in shape, having a diameter of approximately 40 mm and a thickness of approximately 4 mm. Further, the exemplary speaker core 134 has a power of approximately 1.5 Watts and a resistance of approximately 8 Ohms.

It should be appreciated, however, speaker 132 is by way of example only and that in other exemplary embodiments, the speaker 132 can have any other size, shape, and/or configuration for propagating a sound outward from, or relative to, the rear side 106 of the crown 102. For example, in other exemplary embodiments, the hat 100 may not include the foam support structure 136, the speaker 132 may be attached to an outside surface of the crown 102, or the crown 102 may include one or more holes adjacent to where the speaker 132 is positioned inside the crown 102.

The exemplary hat structure 100 of FIG. 5 further includes a light emitting device 142 comprising two light sources 146 and a light pipe 144. The light pipe 144 includes an inwardly facing flange (not shown) that is attached to a periphery 112 of the bill 110 by being sewn into the periphery of the bill 110. Additionally, the light pipe 144 is associated with a light source 146 at each end of the light pipe 144. The light sources 146 are positioned within the crown 102 behind the sweatband 114 and are held in position by a strap 147 sewn into the crown 102. For the exemplary embodiment of FIG. 5, the light sources 146 are light emitting diodes (LEDs) and the light pipe 144 is comprised of a translucent plastic tube configured to distribute light along its length. It should be appreciated, however, that in other exemplary embodiments, the light sources 146 can be any other suitable electric light source, such as, for example, an incandescent light source, and the light pipe can be comprised of any other suitable translucent or transparent material, such as a glass tube. Additionally, in other exemplary embodiments of the present disclosure, the light emitting device 142 may be positioned on the inside surface 108 of the crown 102 and configured to light up a portion of the crown 102, such as an insignia positioned on the outside of the crown. In further exemplary embodiments, however, the hat structure 100 may not include a light emitting device 142 at all.

With continued reference to the exemplary hat structure 100 of FIG. 5, a second control switch 130 is also provided in communication with the control board 120. For the exemplary embodiment of FIG. 5, the second control switch 130 is positioned on the under side of the bill 110 of the hat 100 and is in wired communication with the control board 120. The second control switch 130 is configured to receive a user input corresponding to a command to activate the light emitting device 142. Accordingly, in response to the user input received by the control board 120 from the second control switch 130, the control board 120 is configured to activate the light emitting device 142. The control board 120 may be configured to activate the light emitting device 142 for a predetermined period of time, such as two (2) seconds, four (4) seconds, or any other suitable time period. Alternatively, the control board 120 may be configured to keep light source 142 activated until a second user input is received from the second control switch 130. The control board 120 may also be configured to activate the light source 142 in an alternating manner, such that the light source blinks "On" and "Off" while activated. Such functionality may be achieved by having a switch on the control board 120 configured to alternate the power supply to light source 142 from the control board 120.

Referring specifically to the exemplary embodiment of FIGS. 4 and 5, the control switches are shown positioned on an under side of the bill 110 adjacent to one another. Additionally, for this exemplary embodiment, an indicium 129 is provided on the fabric of the bill 110 over the control switch 128, and a second indicium 131 is provided on the fabric of the bill 110 over the second control switch 130. The indicia 129, 131 can indicate to the user the functionality of the control switches 128, 130. For example, in the exemplary embodiment of FIGS. 4 and 5, indicium 129 indicates a sound source and indicium 131 indicates a light source.

It should be appreciated, however, that in other exemplary embodiments, control switches 128 and 130 may be positioned at any other location suitable to receive a user input, such as, for example, a side of the crown 102. Alternatively, in other exemplary embodiments, control switches 128, 130 may be positioned elsewhere in or on the bill 110, such as, for example, on opposite sides of the bill 110, or on a top side of the bill 110. Additionally, in other exemplary embodiments, hat structure 100 may include any other suitable indicia 129, 131, or alternatively may not include any indicia 129, 131. Further, control switches 128, 130 may be any suitable device for receiving a user input. For example, in certain exemplary embodiments, control switches 128 and 130 may be button controls. Similar to control switch 128, in other exemplary embodiments control switch 130 may also be in wireless communication with the control board 120.

Figure 6:
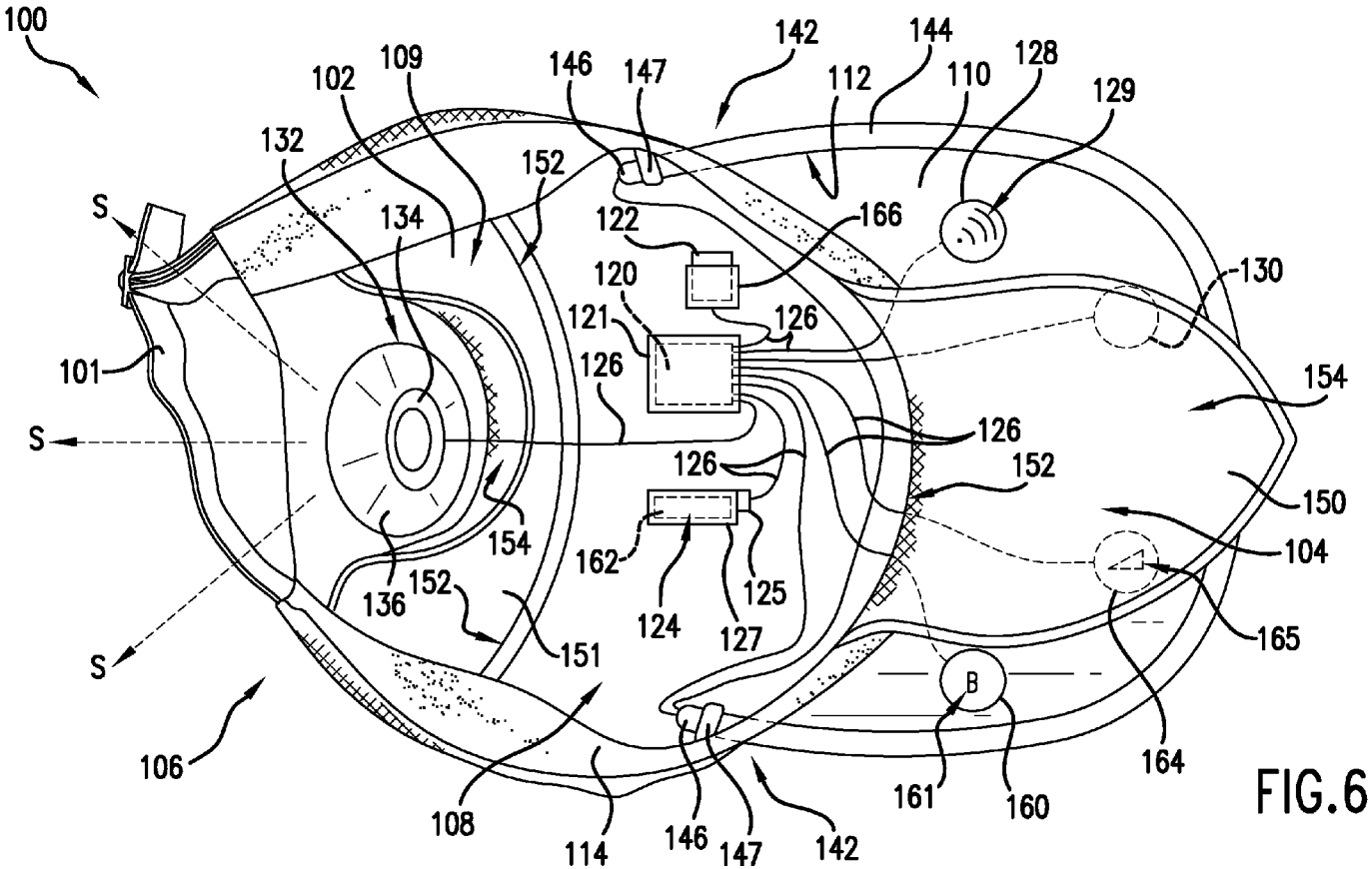
FIG. 6 provides a bottom view of another exemplary hat according to an exemplary embodiment of the present disclosure wherein the electrical components are exposed.

Referring now to FIG. 6, another exemplary embodiment of hat structure 100 is provided. As shown, the exemplary hat structure 100 of FIG. 6 further includes a third control switch 160 and a fourth control switch 164, each in wired communication with the control board 120. The third and fourth control switches 160, 164 are each configured to receive a user input and communicate the user input to the control board 120.

In response to the user input received by the third control switch 160, the control board may be configured to communicate a signal stored in the memory device 122 to the speaker 132, such that the speaker propagates a sound in an outward direction S from, or relative to, the rear side 106 of the crown 102. In such an exemplary embodiment, the memory device 122 may be configured to store a plurality of sound signals, such that at least one sound signal corresponds to the control switch 128 and at least one sound signal corresponds to the third control switch 160. For example, the hat structure 100 may be configured such that in response to a user input received by the third control switch 160, the speaker 132 plays a sound different from the sound it is configured to play in response to a user input received by the control switch 128.

In one exemplary embodiment, for example, the hat structure 100 is configured such that the speaker 132 plays a sound corresponding to positive cheer for a sports team in response to a user input received by the control switch 128, and to play a negative cheer, such as a "Boo," in response to a user input received by the third control switch 160. Such a configuration may greatly enhance a user's enjoyment of a sporting event.

Additionally, the fourth control switch 164 may be configured to control a property of the sound propagated from the speaker 132 in response to a user input received by the switches 128 or 160. In one exemplary embodiment, for example, the fourth control switch 164 may be configured to increase and/or decrease the volume of the sound propagated from the speaker 132.

Similar to the control switch 128 and the second control switch 130, the third and fourth control switches 160, 164 may alternatively be in wireless communication with the control board 120. Additionally, the hat structure 100 also includes indicia 161, 165 positioned on the fabric of the bill 110 over the third control switch 160 and the fourth control switch 164 to indicate to the user the function of the respective control switch 160, 164. For the exemplary embodiment of FIG. 6, the indicium 161 is a "B" and the indicium 165 is a right-triangle shape. However in other exemplary embodiments, the indicia 161, 165 may be any suitable indicia.

For the exemplary embodiment of FIG. 6, the power source 124 includes a removable battery pack 162. The battery pack 162 is removably positioned within the housing 127. For example, the battery pack 162 may be a rechargeable battery pack 162 such that the user may remove the battery pack 162 from the housing 127, and recharge the battery pack 162 using, e.g., a 12 Volt auxiliary power outlet from an automobile (commonly referred to as "cigarette lighter outlets") or an AC power outlet (commonly referred to as a "wall outlet"). In such an embodiment, the rechargeable battery pack 162 may be configured to connect directly into the power outlet or may connect through an auxiliary connector.

With continued reference to the exemplary embodiment of FIG. 6, the memory device 122 is a removable memory device 122. More particularly, for the exemplary embodiment of FIG. 6, the hat structure 100 further includes a receiver 166 in wired communication with the control board 120. The receiver 166 is configured to receive the removable memory device 122 and communicate the one or more stored sound signals to the control board. In such an embodiment, the receiver 166 may be configured to receive and communicate with a USB flash drive or memory card, such as, for example, a Secure Disc (SD) card, a MiniSD card, a Compact Flash card, a Smart Media card, a Subscriber Identity Module (SIM) card, etc. Such an embodiment may allow the user to remove the memory device 122 from the hat structure 100 and download a desired signal from an external source, such as a computing device.

It should be appreciated, however, that in other exemplary embodiments, hat structure 100 may not include the receiver 166. For example, the control board 120 may be configured to receive a removable memory device 122 directly.

Figure 7:
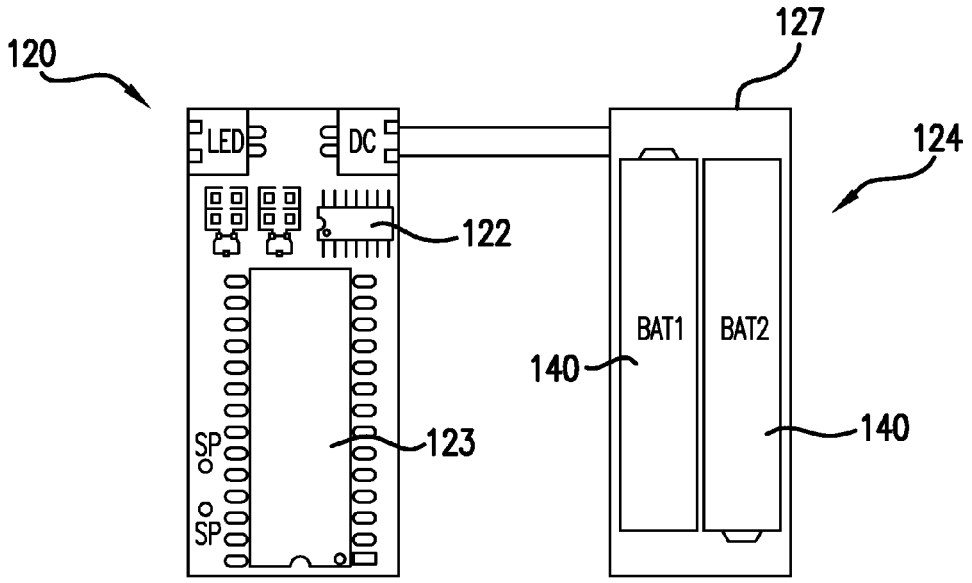
FIG. 7 provides a schematic view of an exemplary control board according to an exemplary embodiment of the present disclosure.
Figure 8:
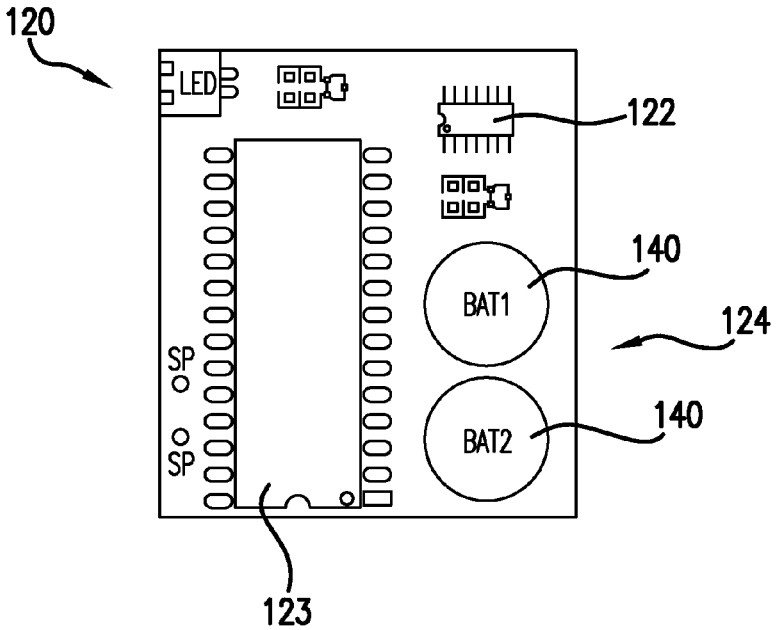
FIG. 8 provides a schematic view of another exemplary control board according to an exemplary embodiment of the present disclosure.

Referring now to FIGS. 7 and 8, two exemplary embodiments of the control board 120 and power source 124 are provided. In the exemplary embodiment of FIG. 7, the control board 120 is shown having a memory device 122 for storing an audio signal or audio file and a main control or processor 123. Additionally, as shown, the power source 124 is a separate power source 124 in electrical communication with control board 120 through a plurality of wires 126 and includes two batteries 140, size AAA. By contrast, the exemplary embodiment of FIG. 8 instead includes two batteries 140 integral with the control board 120. For the exemplary embodiment of FIG. 6, the batteries are flat, button-style batteries. It should be appreciated, however, that in other exemplary embodiments, any suitable control board 120 may be utilized with any suitable power source 124.

This written description uses examples to disclose the invention, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A hat structure, comprising:

a crown defining a front side and a rear side, the crown configured for receipt of a head of a user;

a control board located within the crown and having a sound source associated therewith;

a power source, the power source being in communication with the control board;

a speaker located on the crown and defining a direction of sound propagation outwardly from the rear side of the crown, the speaker being in communication with the control board; and a control switch associated with the control board, the control switch configured to receive a user input and communicate the user input to the control hoard, wherein in response to the user input, the control board communicates a signal from the sound source to the speaker and the speaker plays a sound in the direction of sound propagation.

2. The hat structure of claim 1, further comprising a bill extending from and attached to the front side of the crown, wherein the control is positioned on the bill.

3. The hat structure of claim 1, wherein the crown defines an inside surface and wherein the speaker is located on the inside surface of the crown.

4. The hat structure of claim 1, wherein the sound source is a memory device located on the control board.

5. The hat structure of claim 1, wherein the crown further defines an inside surface, and wherein the control board and the power source are located on the inside surface of the crown.

6. The hat structure of claim 1, wherein the sound source is a memory device in communication with the control board, and wherein the memory device is a removable memory device.

7. The hat structure of claim 1, wherein the power source comprises one or more batteries.

8. The hat structure of claim 1, further comprising a light emitting device.

9. The hat structure of claim 8, wherein the light emitting device is in communication with the control board.

10. The hat structure of claim 8, wherein the light emitting device comprises a light pipe defining a first end and a second end, and one or more light sources positioned at the first end of the light pipe, the second end of the light pipe, or both.

11. The hat structure of claim 10, further comprising a bill extending from and attached to the front side of the crown, wherein the light pipe is attached along a periphery of the bill.

12. The hat structure of claim 8, further comprising a second control switch configured to receive a user input corresponding to a command to activate the light emitting device, wherein the second control switch and the light emitting device are in communication with the control board, and wherein the control board is configured to activate the light emitting device in response to the user input from the second control switch.

13. The hat structure of claim 1, wherein the control board is in wired communication with the speaker, the power source, and the control switch.

14. The hat structure of claim 1, wherein the control board is in wireless communication with the speaker, the control switch, or both.

15. The hat structure of claim 1, further comprising:

one or more pads defining an end, a first side, and an opposite second side, wherein the end is attached to an inside surface of the crown, and wherein the first side faces the inside surface of the crown and contacts one or more of the power source, the control board, and the speaker.

16. The hat structure of claim 1, wherein the power source comprises one or more batteries integral with the control board.

17. The baseball-style hat of claim 1, wherein the control board is attached to the crown and in communication with the control switch and the speaker, wherein the sound source is a memory device located on the control board, the memory device storing an audio file that when communicated to the speaker activates the speaker such that it plays the sound, and wherein the control board is configured to communicate the audio file to the speaker after the user input is communicated from the control switch.

18. The baseball-style hat of claim 17, wherein the power source in electrical communication with the control board.

19. The baseball-style hat of claim 18, wherein the crown further defines a top end and wherein the control board, the power source, or both are attached to the top end of the crown within the inside area of the crown.

* * * * *